US010227814B2

(12) United States Patent
Summy

(10) Patent No.: US 10,227,814 B2
(45) **Date of Patent: *Mar. 12, 2019**

(54) CORNER FLASHING SYSTEM

(71) Applicant: Gene Summy, Las Flores, CA (US)

(72) Inventor: Gene Summy, Las Flores, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/284,314

(22) Filed: Oct. 3, 2016

(65) Prior Publication Data

US 2017/0247878 A1 Aug. 31, 2017

Related U.S. Application Data

(60) Continuation of application No. 14/715,165, filed on May 18, 2015, now Pat. No. 9,458,627, which is a (Continued)

(51) Int. Cl.
*E06B 1/62* (2006.01)
*E04B 1/68* (2006.01)
(Continued)

(52) U.S. Cl.
CPC ..... *E06B 1/62* (2013.01); *B21D 28/26* (2013.01); *E04B 1/665* (2013.01); *E04B 1/68* (2013.01); *E04B 1/6801* (2013.01); *E04B 1/6803* (2013.01); *E04F 21/0038* (2013.01); *E06B 1/342* (2013.01); *E06B 2001/628* (2013.01)

(58) Field of Classification Search
CPC . E04B 1/68; E04B 1/62; E04B 1/6801; E04B 1/665; E04B 1/6803; E04F 21/0038; E06B 2001/628
USPC ..... 52/717.01, 741.3, 741.4, 58, 60, 302.6, 52/302.1, 746, 287.1, 97, 204.2, 204.53, 52/211, 204.1, 212, 204.52, 61, 656.5, 52/656.6, 656.7, 656.2, 745.15, 745.16, 52/204.5, 204.51, 209, 169.14, 169.5, 52/293.3, 293.1, 293.2; 156/71, 304.1, 156/304.2, 304.4, 304.5, 304.6, 304.7, 156/299, 300, 301, 302, 303; 49/504
See application file for complete search history.

(56) References Cited

U.S. PATENT DOCUMENTS 3,238,679 A * 3/1966 Capoccia ..... E06B 1/26 52/204.55
3,451,178 A * 6/1969 Beale ..... E06B 7/16 4/612
(Continued)

*Primary Examiner* — Adriana Figueroa
*Assistant Examiner* — Jessie T Fonseca
(74) *Attorney, Agent, or Firm* — Knobbe, Martens, Olson & Bear LLP

(57) ABSTRACT

A corner flashing system is provided for sealing the corners of recessed window frames against moisture penetration. In a preferred embodiment, the system comprises first and second double-flap members, a half-cube member, and caulking. The first and second double-flap members, and the half-cube member are preferably made of asphalt or petroleum based material. In another preferred embodiment, the system comprises one double-flap member, a modified half-cube member, and caulking. In another preferred embodiment, the system comprises a single member that combines a double-flap member and a half-cube member, and caulking. In another preferred embodiment, the system comprises a combination member, a double-flap member, and caulking.

12 Claims, 15 Drawing Sheets

Related U.S. Application Data continuation of application No. 13/799,219, filed on Mar. 13, 2013, now Pat. No. 9,032,688, which is a continuation of application No. 13/326,067, filed on Dec. 14, 2011, now abandoned, which is a continuation of application No. 12/786,366, filed on May 24, 2010, now abandoned, which is a continuation of application No. 10/975,960, filed on Oct. 28, 2004, now Pat. No. 7,735,291, which is a division of application No. 09/915,495, filed on Jul. 26, 2001, now abandoned.

(60) Provisional application No. 60/243,856, filed on Oct. 27, 2000.

(51) Int. Cl.

| | |
|---|---|
| ***E04B 1/66*** | (2006.01) |
| ***B21D 28/26*** | (2006.01) |
| ***E04F 21/00*** | (2006.01) |
| ***E06B 1/34*** | (2006.01) |

(56) References Cited

U.S. PATENT DOCUMENTS

| | | | | | |
|---|---|---|---|---|---|
| 3,698,142 | A * | 10/1972 | Theriault | E04D 13/1475 | 52/556 |
| 4,248,926 | A * | 2/1981 | Tajima | B32B 11/02 | 428/343 |
| 4,555,882 | A * | 12/1985 | Moffitt | E06B 1/70 | 52/209 |
| 4,700,512 | A * | 10/1987 | Laska | E04B 1/0007 | 52/287.1 |
| 4,775,567 | A * | 10/1988 | Harkness | B32B 11/04 | 428/351 |
| 4,872,296 | A * | 10/1989 | Janni | B29C 65/02 | 52/287.1 |
| 5,077,943 | A * | 1/1992 | McGady | E04D 13/1475 | 52/219 |
| 5,109,641 | A * | 5/1992 | Halan | E04D 13/1478 | 52/276 |
| 5,218,793 | A * | 6/1993 | Ball | E04B 1/70 | 52/169.5 |
| 5,414,964 | A * | 5/1995 | Bodycomb | E04D 13/1407 | 285/42 |
| 5,586,415 | A * | 12/1996 | Fisher | E06B 1/62 | 52/58 |
| 5,706,610 | A * | 1/1998 | Mayle | E04D 13/1407 | 285/42 |
| 5,815,986 | A * | 10/1998 | Laska | E04B 1/703 | 52/204.2 |
| 5,913,779 | A * | 6/1999 | Edvardsen | E04D 13/1475 | 52/58 |
| 5,927,039 | A * | 7/1999 | De Boer | E06B 1/62 | 403/402 |
| 6,035,582 | A * | 3/2000 | Pacific | E04B 1/66 | 428/189 |
| 6,070,370 | A * | 6/2000 | Locke | E04D 13/1407 | 52/287.1 |
| 6,098,343 | A * | 8/2000 | Brown | E06B 1/702 | 49/471 |
| 6,119,416 | A * | 9/2000 | Larson | E06B 1/62 | 49/504 |
| 6,122,874 | A * | 9/2000 | Smerilli | E04B 1/644 | 52/169.14 |
| 6,122,887 | A * | 9/2000 | Massett | E02D 31/02 | 52/169.11 |
| 6,256,956 | B1 * | 7/2001 | Davis | E06B 1/62 | 277/645 |
| 6,327,820 | B1 * | 12/2001 | Picco | E04D 13/02 | 52/58 |
| 6,401,401 | B1 * | 6/2002 | Williams | E06B 1/62 | 49/471 |
| 6,401,402 | B1 * | 6/2002 | Williams | E06B 1/62 | 49/471 |
| 7,735,291 | B2 * | 6/2010 | Summy | E06B 1/62 | 52/302.6 |
| 2001/0034984 | A1 * | 11/2001 | Murphy | E06B 1/62 | 52/204.5 |
| 2002/0050103 | A1 * | 5/2002 | Ackerman, Jr. | E06B 1/62 | 52/58 |
| 2003/0056444 | A1 * | 3/2003 | Ackerman, Jr. | E06B 1/62 | 52/58 |

* cited by examiner

CORNER FLASHING SYSTEM

RELATED APPLICATIONS

Any and all priority claims identified in the Application Data Sheet, or any correction thereto, are hereby incorporated by reference under 37 CFR 1.57.

BACKGROUND OF THE INVENTION

Field of the Invention

The present invention relates to systems for providing a water-tight seal at the corners of structures. More specifically, a preferred embodiment provides a device and method for flashing and sealing the corners of recessed window frames and recessed window wall conditions.

Description of the Related Art

In the construction of new homes, it is important to provide a water-tight seal at the seams of any openings in exterior walls, specifically windows and doors. A number of different devices and methods of providing such a seal are in current use. All of these methods have at least one major drawback. Some are expensive, some are time consuming, some must be performed just right in order to be effective, some are not durable, and some create sharp edges that cut subsequent layers of building materials.

One specific type of condition that is installed in many homes today is the recessed window. Recessed windows include an outer wall opening that is flush with the exterior of the house, and an inner, recessed framed opening, that lies in a plane behind that of the exterior. Generally, the inner framed opening has a height and width less than that of the outer framed opening. When the window is finally installed, it lies within the inner framed opening.

Recessed windows are particularly difficult to flash and seal adequately, especially at the corners. Rain, especially wind-driven rain, tends to penetrate the corners of these windows rather easily. When this water infiltrates the space behind the flashing, it becomes trapped there and causes rotting and deterioration of the underlying wood, as well as fungus, mold and mildew growth within the wall systems.

The inadequacy of current flashing systems is due to two problems. First, there is no known flashing system that is very reliable, even if installed correctly. Second, most flashing is performed by unskilled low-wage laborers. Most of these workers pay little attention to quality, and instead try to get the job done as quickly as possible. Further, many lack the language skills necessary to understand the detailed instructions that must be given by a supervisor in order to ensure a proper flashing. Because it is not cost effective to have a supervisor inspect every corner of every recessed window, many windows are installed with poor flashing. As a result, many flashing systems that might be effective if installed properly every time do not work well in practice. Therefore, there is a need for a corner flashing system that is not only effective when correctly installed, but is also nearly impossible to install incorrectly. Further, the system should be well adapted to installation in recessed window frames.

SUMMARY OF THE INVENTION

The corner flashing system according to the following preferred embodiments has several features, no single one of which is solely responsible for its desirable attributes. Without limiting the scope of this invention as expressed by the claims that follow, its more prominent features will now be discussed briefly. After considering this discussion, and particularly after reading the section entitled "Detailed Description of the Drawings," one will understand how the features of this flashing system provide advantages, which include reliability, low cost, and foolproof installation.

One preferred embodiment provides two uniquely shaped members that have outstanding water sealing capabilities. The members comprise sheets of flashing material, preferably of a petroleum or asphalt base, that are specially cut and formed to be adapted to fit into window and door frame corners. One preferred embodiment combines these members to provide a three-member corner flashing system for installation in recessed window frames.

The first member, the double-flap member, is formed from a substantially rectangular flat sheet of water-impermeable material, preferably one having an asphalt or petroleum base. The dimensions of the sheet are appropriate for the size of the window frame that is to be sealed, but preferred embodiments include sheets measuring approximately 6"×9", 8"×9", 16½"×9", 22½×9", 28½"×9" and 34½"×9". Testing has revealed that a 9" width for the flat sheet is adequate to provide a leak-proof seal for the flashed corner. However, smaller and larger widths are also adequate, and the 9" preferred width is in no way intended to limit the scope of coverage for the flashing system. For ease of reference, however, a sheet having a 9" width will be used to describe the following methods of forming and installing the flashing system.

With the flat sheet oriented such that one 9" edge defines the bottom edge, the sheet is cut, starting from the center of the bottom edge, approximately 4½" up from the bottom. The sheet is then creased along two lines. The first line intersects the terminus of the cut and runs in a direction perpendicular to the cut. The second line also intersects the cut, but extends upward in the same direction as the cut.

When the sheet is folded along these two creases, so that each crease defines a ninety-degree angle, the formerly flat sheet defines two rectangular flaps in the plane of the flat sheet, joined at one corner, each having attached to one edge a sealing flange that extends perpendicularly into the plane of the flat sheet, the two flanges forming an "L".

To secure the double-flap member permanently in this shape, a piece of water-impermeable material having an adhesive backing is secured along the adjacent edges of the rectangular flaps that lie in the plane of the former flat sheet. The piece of adhesive-backed material may be of a substantially rectangular shape, or of any other shape, such as triangular, that is adapted to overlap and secure the adjacent edges of the rectangular flaps. As an optional final step, a second piece of adhesive backed water-impermeable material may be secured to the opposite side of the first piece of adhesive backed water-impermeable material, such that the adhesive surfaces face one another.

The second member, the half-cube member, is formed from the same or a similar water-impermeable material as the double-flap member. Again, the process begins with a substantially rectangular flat sheet of appropriate dimension. Preferred dimensions for this sheet are 8"×9". With the sheet oriented such that one 9" edge defines the bottom edge, the sheet is cut along its bottom edge, one-half of the way up. Again, two creases are formed intersecting the terminus of the cut, one continuing in the direction of the cut and one running perpendicularly to it. For this member, however, the creases are folded in the opposite direction as the double-flap member, so that the resultant shape is similar to a half-cube, with all three sides sharing three common edges. To secure this member permanently in this shape, a strip of adhesive backed water-impermeable material is applied along at least one edge of the member.

In one preferred embodiment, two of the double-flap members are combined with one of the half-cube members to create a three-member flashing system that is specially adapted to seal the corners of recessed window frames. To install the system, the first double-flap member is placed in the corner of the outer frame so that the vertex of the two sealing flanges sits in the corner and the remainder of the member protrudes from the front of the frame. The back surfaces of the two rectangular flaps should each lie flush with the front surface of the outer frame. The installer then secures the double-flap member to the frame by any appropriate method. One preferred method is a hammer stapler. Because the preferred flashing material is asphalt or petroleum based, it is self-sealing. Thus, the staples do not compromise the sealing ability of the flashing material.

When the double-flap member has been secured, the second member, which is a half-cube member, is placed on top of it so that the corner of the half-cube rests in the corner of the frame and each surface of the half-cube is flush with either the front surface of the recessed frame, the inside vertical surface of the outer frame, or the inside horizontal surface of the outer frame. The two surfaces that face the inside surfaces of the outer frame should partially overlap the sealing flanges of the first member. When properly positioned, the second member is secured into place, preferably with staples.

Finally, the third member, which is substantially identical to the first double-flap member, is placed in the corner of the recessed frame in exactly the same manner as the first member was placed in the corner of the outer frame. The portion of this member that protrudes from the front of the frame should overlap and partially cover the surface of the second member that faces the front of the recessed frame. When properly positioned, this member is secured into place, preferably with staples.

To complete the flashing of the recessed window, the remaining corners are finished in the same manner just described, and flashing material is applied to the remaining surfaces of the frame in a manner well known within the art.

DETAILED DESCRIPTION OF THE PREFERRED EMBODIMENTS

Figure 1B:
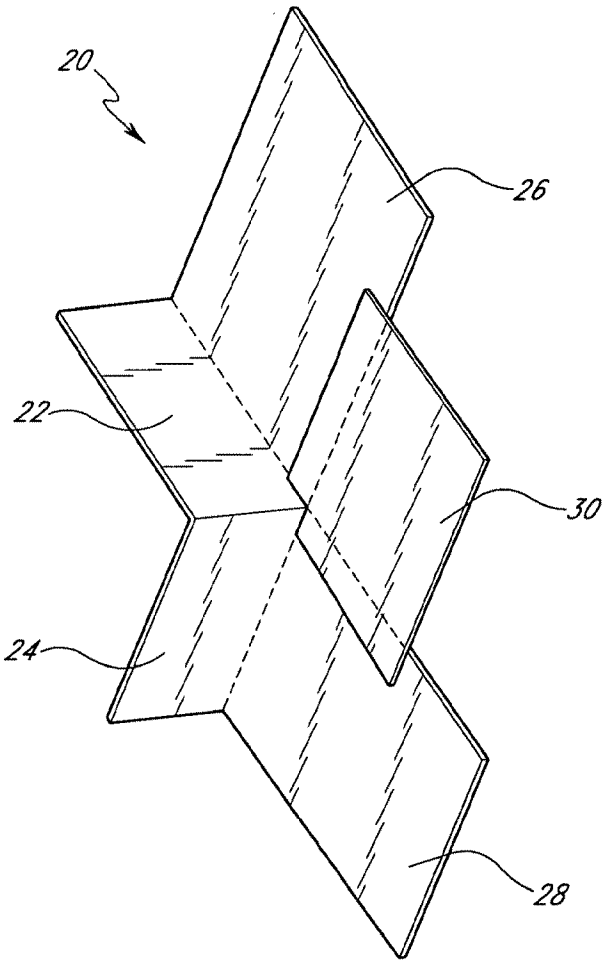
FIGS. 1A-1B are perspective views of a preferred embodiment of the double-flap member, from the front and back, respectively.
Figure 1A:
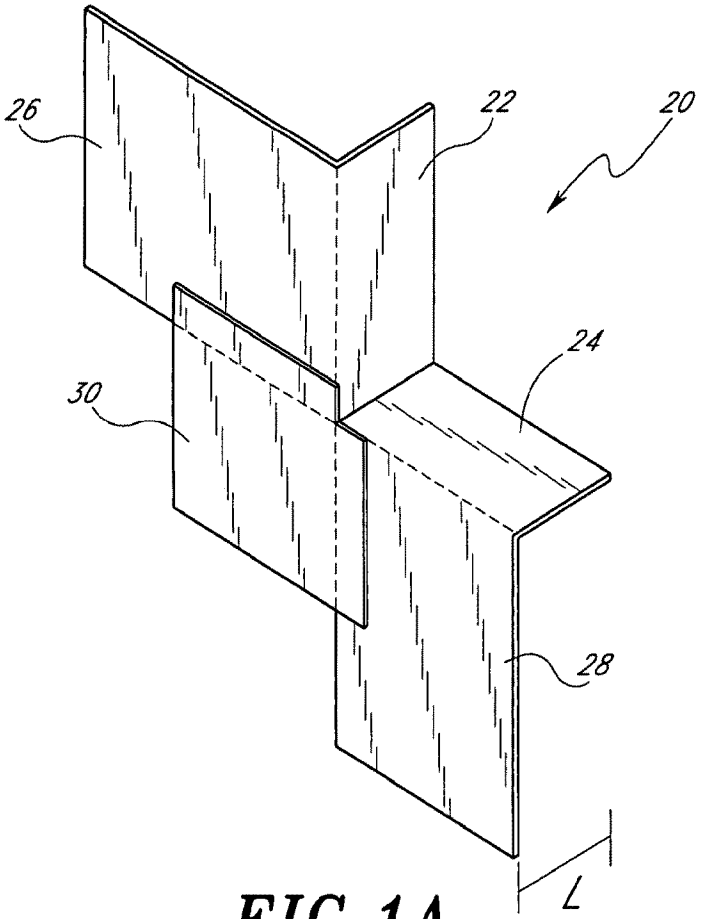

FIGS. 1A-B illustrate one preferred embodiment of a double-flap member 20. This member 20 is preferably constructed of an asphalt or petroleum based flashing material, although it will be understood by one skilled in the art that a variety of other materials having water-resistant properties may also be used. This member 20 comprises a vertical seating flange 22 and a horizontal seating flange 24, which are joined at a 90° angle. The vertical flange 22 preferably has substantially the same dimensions as the horizontal flange 24. The length L of the flanges, defined as the direction parallel to both planes defined by the flanges, is appropriate for the dimensions of the structure in which the flanges are installed. Preferred lengths are 1½", 3⅛", 12", 18", 24" and 30". FIG. 1D illustrates a double-flap member 20 having a long dimension L.

Extending at a 90° angle from one edge of the vertical flange 22 is a substantially rectangular first flap 26. Extending at a 90° angle from one edge of the horizontal flange 24, is a substantially rectangular second flap 28. The two flaps 26, 28 extend from the same side of the flanges 22, 24, so that both flaps 26, 28 lie in the same plane.

Joining the first flap 26 to the second flap 28 is a web 30. A preferred shape for the web 30 is rectangular, although it will be appreciated by one of skill in the art that other shapes, such as triangular, may be equally useful. The web 30 is preferably constructed from two substantially identical pieces of a flashing material that has an adhesive backing. Preferably, the web 30 is made of a material having an asphalt or petroleum base. The two pieces making up the web 30 face one another on their adhesive sides. The web 30 is secured to and partially overlaps the adjacent edges of the flaps 26, 28, such that two edges of the web 30 are parallel to the adjacent edges of the flaps 26, 28.

Figure 1C:
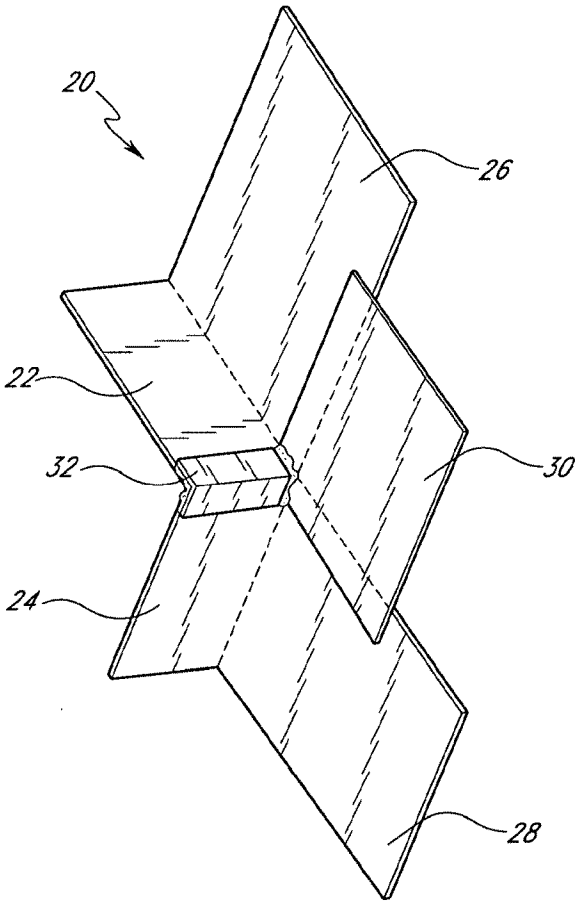
FIG. 1C is a rear perspective view of another preferred embodiment of the double-flap member, illustrating the pre-applied rope caulking.
Figure 1D:
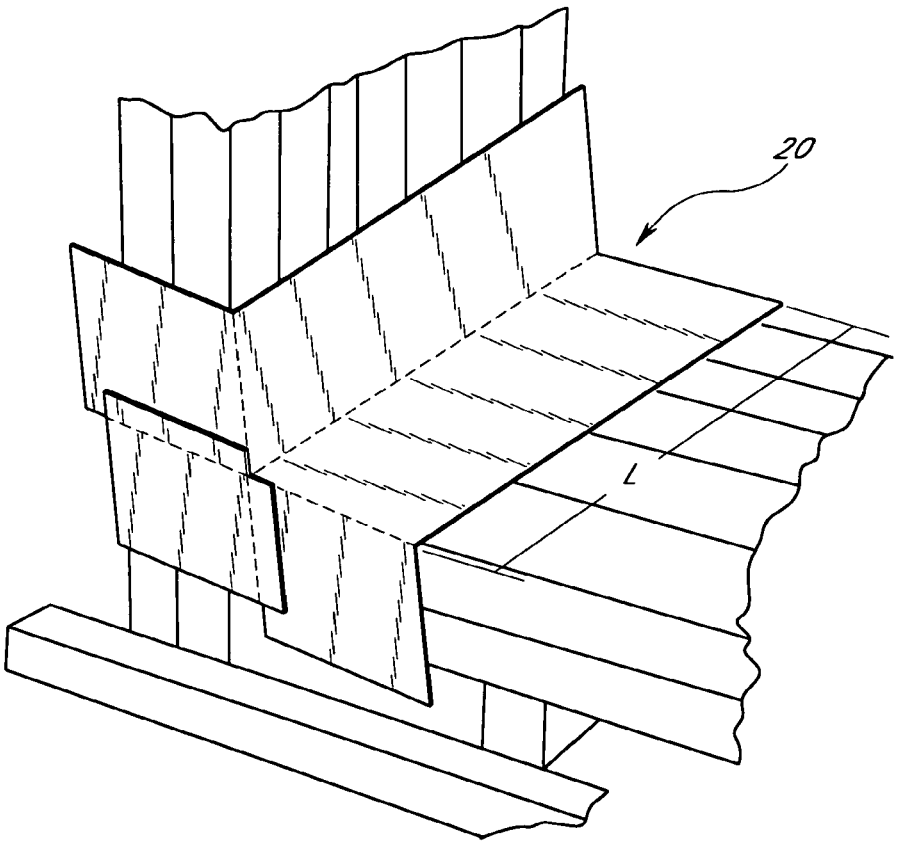
FIG. 1D is a perspective view of a corner of a recessed window frame having a deep recess, illustrating a double-flap member that is adapted to fit such a deep recess.

As illustrated in FIG. 1C, one alternative embodiment of the double-flap member 20 includes a pre-installed length of rope caulking 32 having a protective backing. Pre-installation of this caulking 32 eliminates one step in the process of installing the flashing system, as explained in detail below.

Figure 2B:
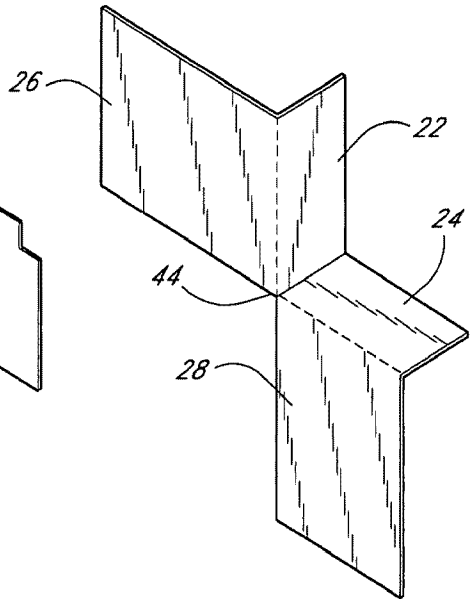
FIGS. 2A-2C are perspective views of a preferred embodiment of the double-flap member, illustrating the manner in which this member is cut and formed.
Figure 2C:
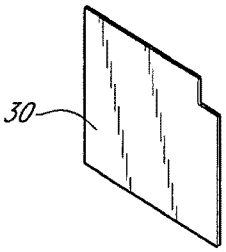
Figure 2C:
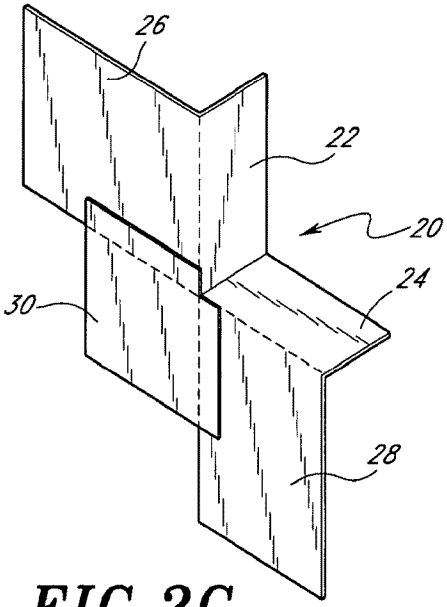
Figure 2A:
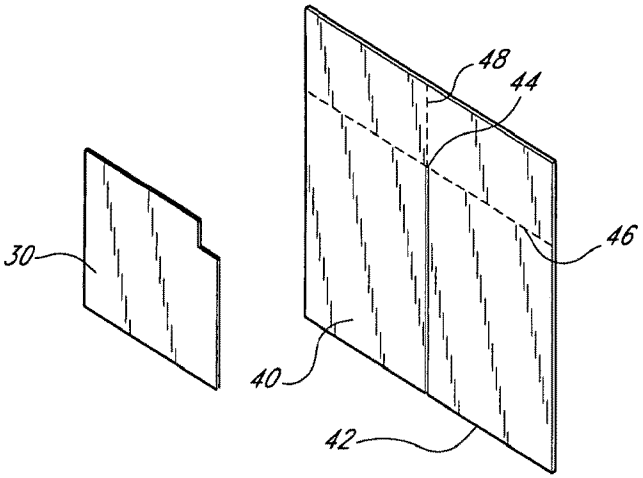

The double-flap member 20 is preferably formed as illustrated in FIGS. 2A-2C. The manufacturer begins with a substantially rectangular flat sheet 40 of flashing material, preferably one having an asphalt or petroleum base. The dimensions of the sheet 40 are appropriate for the size of the window frame that is to be sealed. In one preferred embodiment, the sheet 40 is approximately 8"×9". Other preferred dimensions include 6"×9", 16½"×9", 22½"×9", 28½"×9" and 34½"×9".

With the flat sheet 40 oriented such that one 9" edge defines the bottom edge 42 of the sheet 40, the manufacturer makes a straight cut across the sheet, starting from the center of its bottom edge 42, to a terminus 44 that is preferably approximately 4½" up from the bottom 42. Shorter or longer cuts are also acceptable, but a sufficient length of material is preferably left uncut to form the flanges 22, 24. The sheet 40 is then creased as shown in FIG. 2A. A horizontal crease 46 intersects the terminus 44 of the cut and runs in a direction perpendicular to the cut. A vertical crease 48 also intersects the terminus 44, but extends upward in the same direction as the cut. When the sheet 40 is folded along these two creases 46, 48, so that each crease 46, 48 defines the vertex of a ninety-degree angle, the formerly flat sheet 40 defines a first flap 26 and a second flap 28 that each lie in the plane of the flat sheet 40 and do not overlap one another. The first and second flaps 26, 28 are joined at the terminus 44 of the cut.

Projecting into the plane of the former flat sheet 40 from one edge of each flap 26, 28 are two seating flanges, one horizontal 24 and one vertical 22. The vertical 22 and horizontal 24 seating flanges are attached to one another along an edge that extends perpendicularly into the plane of the flat sheet and terminates at one end in the terminus 44 of the cut where the first flap 26 and second flap 28 meet.

To secure the double-flap member 20 permanently in this shape, a substantially rectangular piece of flashing material, a web 30, having an adhesive backing is secured along the adjacent edges of the flaps 26, 28, which were joined prior to being cut. Preferably, the adhesive surface of the web 30 is covered so as to prevent the double-flap member 20 from sticking to neighboring pieces, as in a bulk package of double-flap members 20. Preferably, this covering comprises a second piece of adhesive backed flashing material (not shown), substantially the same shape as the web 30, and secured to the adhesive side of the web 30 such that the adhesive surfaces of each piece face one another.

Figure 3B:
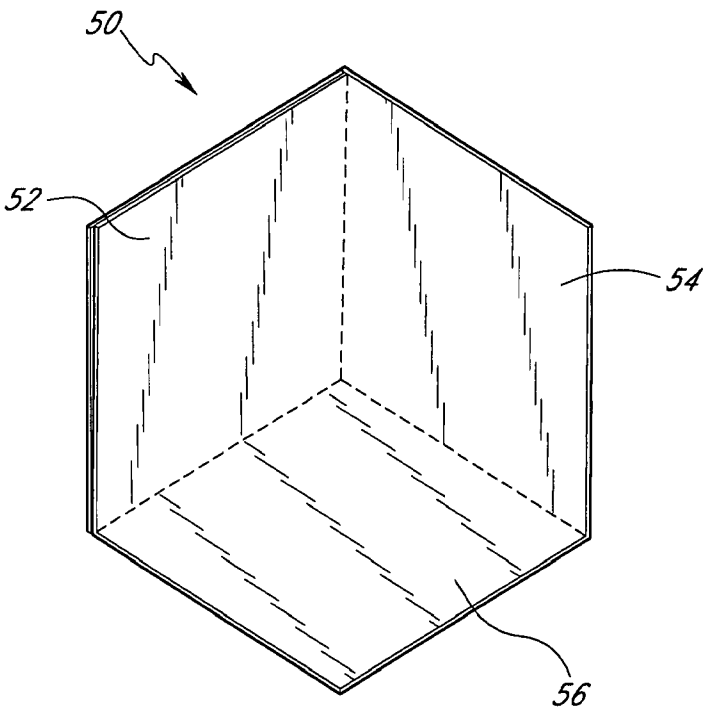
FIGS. 3A-3B are perspective views of a preferred embodiment of the half-cube member, from the front and back, respectively.
Figure 3A:
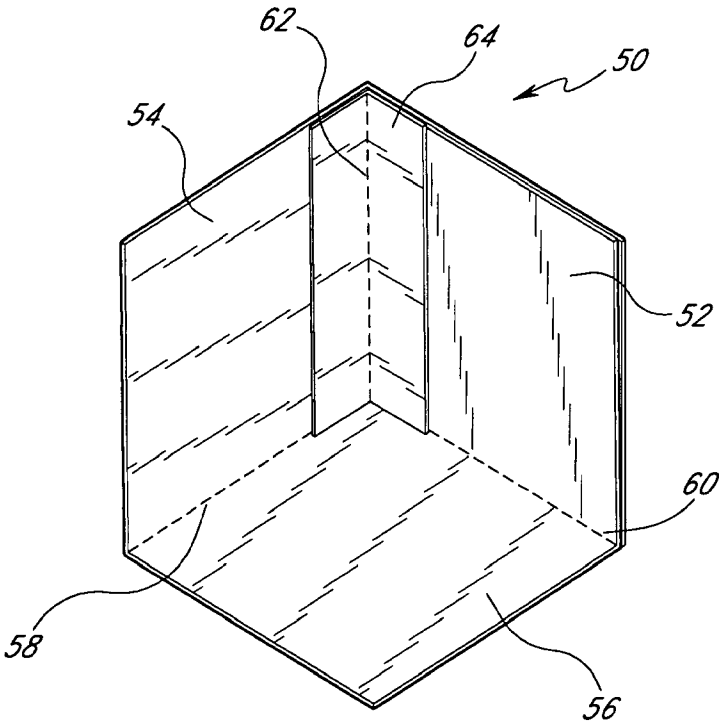

FIGS. 3A and 3B illustrate a preferred embodiment of a half-cube member 50. This member 50 is preferably constructed of an asphalt or petroleum based flashing material, although it will be understood by one skilled in the art that a variety of other materials having water-resistant properties may also be used. This member 50 comprises a first face 52, a second face 54 and a third face 56, with all three faces 52, 54, 56 lying at right angles to one another. All three faces 52, 54, 56 share three common edges 58, 60, 62, such that the second face 54 and third face 56 share edge 58, second face 54 and first face 52 share edge 62, and third face 56 and first face 52 share edge 60. The half-cube member 50 retains its shape through the addition of a strip of adhesive backed flashing material 64 along the outside of edge 60, or along the inside of edge 62, or along both edges 60, 62.

Although the illustrated embodiment of the half-cube member 50 includes substantially rectangular faces, one of skill in the art will appreciate that the faces may be any of a variety of different shapes without departing from the spirit of the invention. For example, by cutting diagonally across one or more of the faces 52, 54, 56, the half-cube member will comprise three substantially triangular faces.

FIGS. 4A-4D illustrate a preferred method of constructing the half-cube member 50. The manufacturer begins with a substantially rectangular flat sheet 70 of flashing material. Preferably, the material is identical or substantially identical to the material used to construct the double-flap member 20. The sheet 70 is of appropriate dimension for the window frame that is to be flashed. Preferred dimensions are 8"×9".

With the sheet 70 oriented such that one 9" edge defines a bottom edge 72, the manufacturer makes a straight cut across the sheet starting from the center of the bottom edge 72 and ending at a terminus 74 that is approximately one-half of the way up from the bottom 72. The cut thus forms two flaps 76, 78. The manufacturer then forms a horizontal crease 80 and a vertical crease 82, each intersecting the terminus 74 of the cut. The horizontal crease 80 runs perpendicularly to the cut, while the vertical crease 82 runs in the same direction as the cut.

Figure 4A:
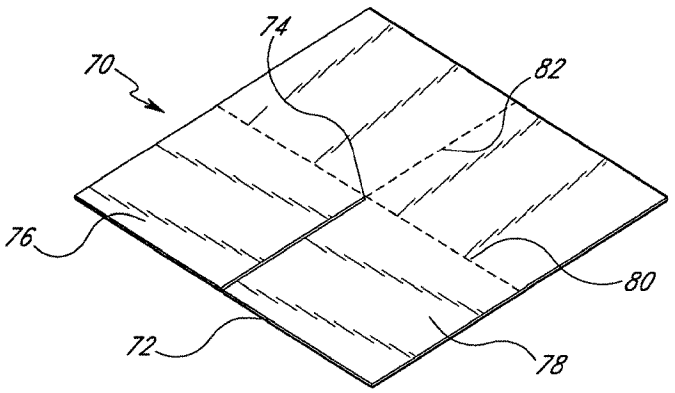
FIGS. 4A-4D are perspective views of a preferred embodiment of the half-cube member, illustrating the manner in which this member is cut and formed.
Figure 4B:
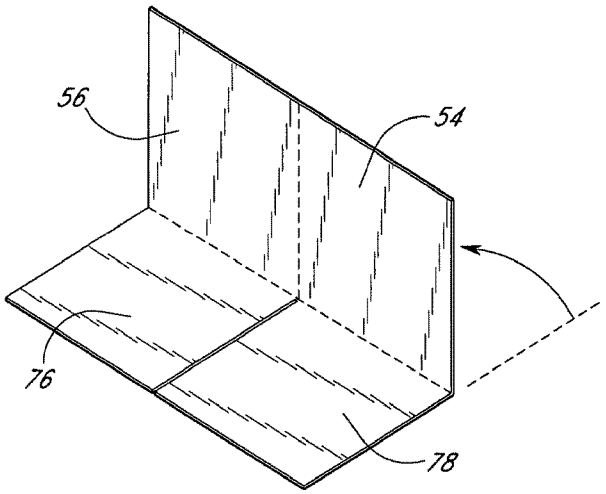
Figure 4C:
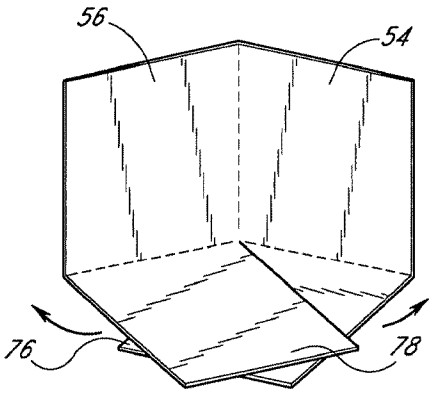
Figure 4D:
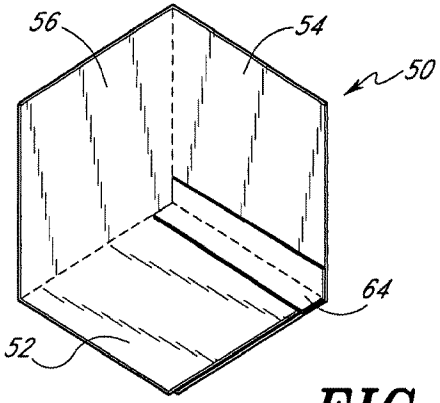

The manufacturer then folds the creases for the half-cube member 50 in the opposite direction as for the double-flap member 20 so that the two flaps 76, 78 substantially overlap one another and the member 50 resembles a half-cube with three faces 52, 54, 56 sharing three common edges 58, 60, 62. To secure this member 50 permanently in the shape of a half-cube, a strip of adhesive backed flashing material 64 is applied along the inside of edge 60 of the half-cube member 50, where the cut edge of flap 78 meets face 54, as illustrated in FIG. 4D.

Figure 5A:
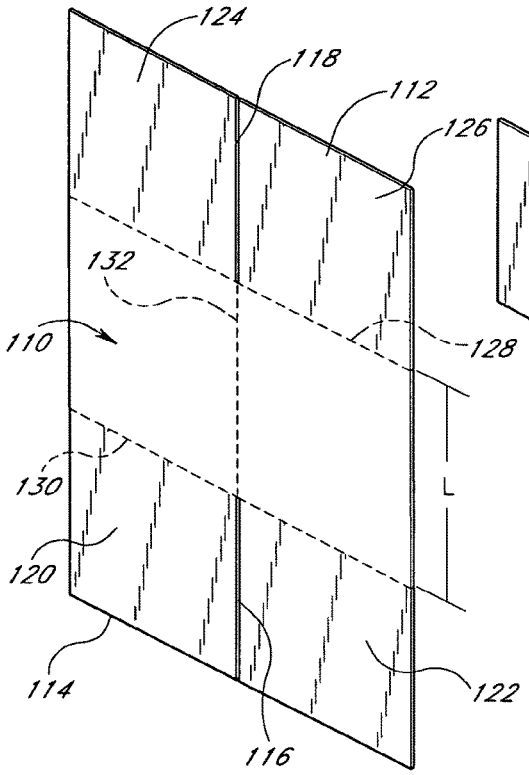
FIGS. 5A-5D are perspective views of a preferred embodiment of the combination member, illustrating the manner in which this member is cut and formed.
Figure 5C:
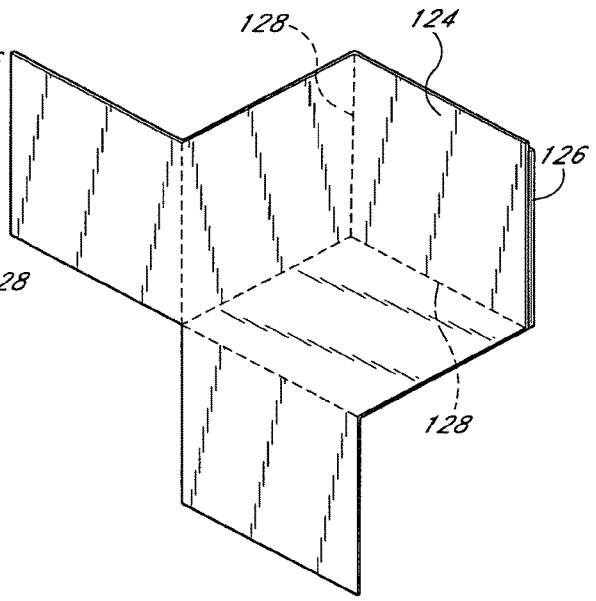

If desired, both the double flap member 20 and the half-cube member 50 may be constructed from a single sheet of flashing material. A complete combination member 102 is illustrated in FIG. 5D. A preferred method of forming the combination member 102 is illustrated in FIGS. 5A-5D. The manufacturer begins with a single sheet of flashing material 110. Preferably, the sheet is rectangular, having a bottom edge 112 and a top edge 114 that are each approximately 9" in length, and side edges of length 9"+L. L preferably corresponds to the depth of the window to be flashed, as explained below.

The manufacturer makes two straight cuts across the sheet, the first cut 116 begins at the center of the bottom edge 114 and continues vertically for approximately 4½". The second cut 118 begins at the center of the top edge 112 and continues vertically for approximately 4½". The first cut 116 thus forms a first flap 120 and a second flap 122, and the second cut forms a third flap 124 and a fourth flap 126. The manufacturer also forms three creases in the sheet. The first two creases 128, 130 extend horizontally across the sheet, each intersecting the terminus of one of the cuts 116, 118. The third crease 132 extends vertically across the sheet between the two termini of the cuts 116, 118.

Figure 5B:
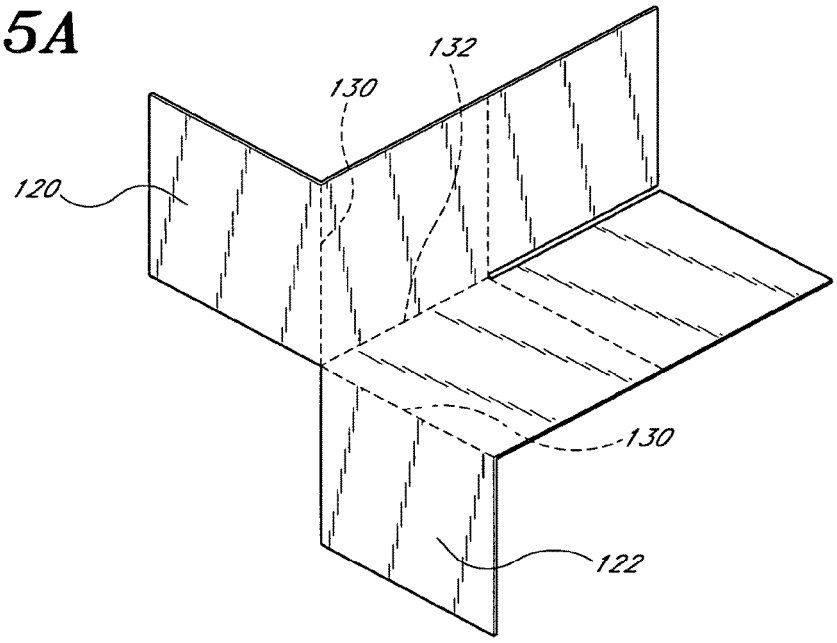
Figure 5D:
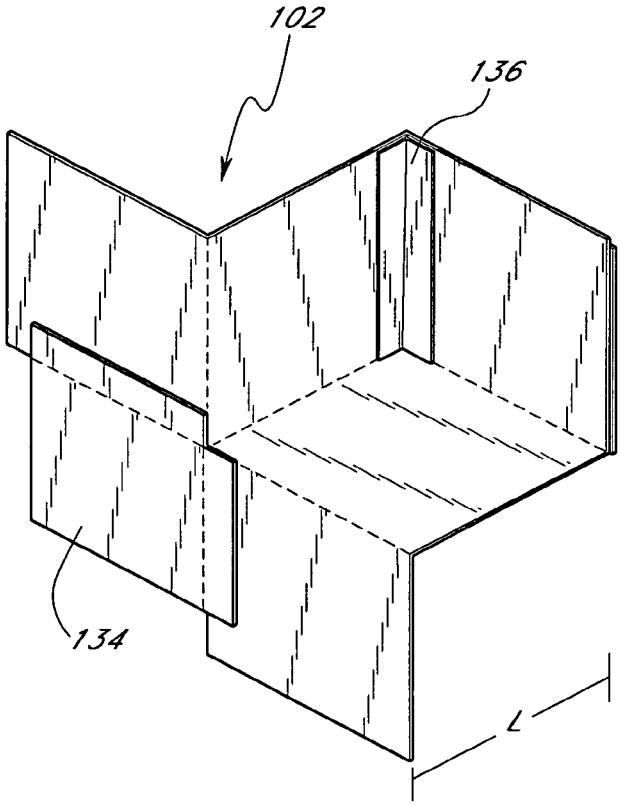

To form the double flap component of the combination member 102, the first flap 120 and second flap 122 are separated while the first horizontal crease 130 is folded to a 90° angle and the vertical crease 132 is similarly folded to a 90° angle, as illustrated in FIG. 5B. To form the half-cube component of the combination member 102, the third flap 124 and fourth flap 126 are brought together while the second horizontal crease 128 is folded to a 90° angle, as illustrated in FIG. 5C. To secure the combination member 102 in this configuration, a web 134 is added to the double flap component in the same manner as above, and a strip of adhesive-backed flashing material 136 is added to one edge of the half-cube component in the same manner as above.

FIGS. 6-10 illustrate one preferred method of combining and installing the members 20, 50 in a recessed window frame 82. The recessed window frame 82 has an outer frame 84 and an inner frame 86. The outer frame 84 has a vertical support 88, a horizontal sill 90, and a front surface 92. The inner frame 86 has a front surface 94, a vertical support 98 and a horizontal sill 100.

Figure 6:
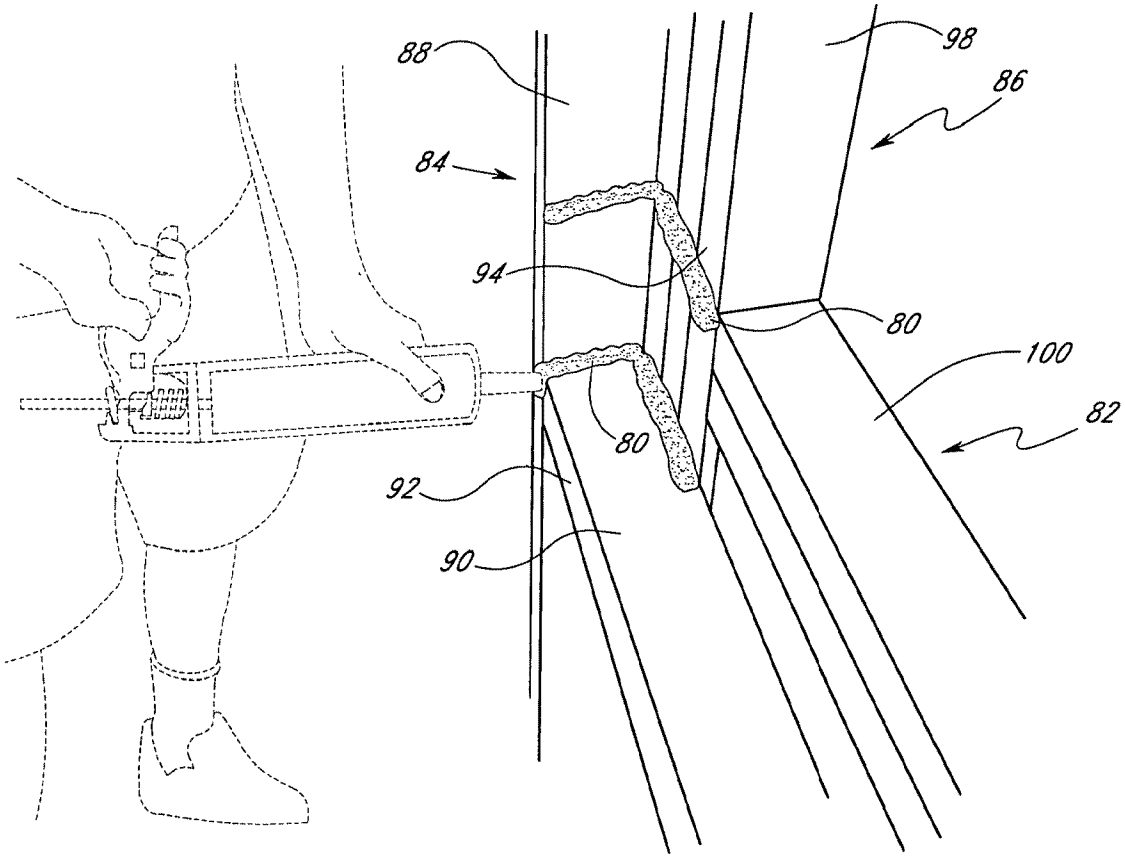
FIG. 6 is a perspective view of a corner of a recessed window frame, illustrating the step of applying caulk to the corner.
Figure 8:
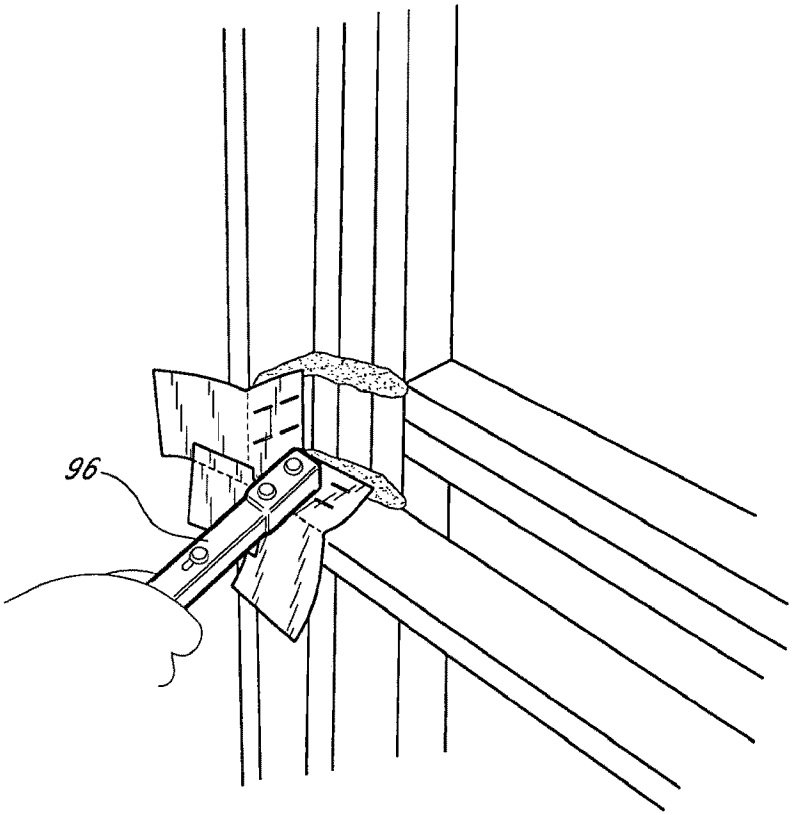
FIG. 8 is a perspective view of a corner of a recessed window frame, illustrating the step of securing the first double-flap member in the corner using a hammer stapler.
Figure 7:
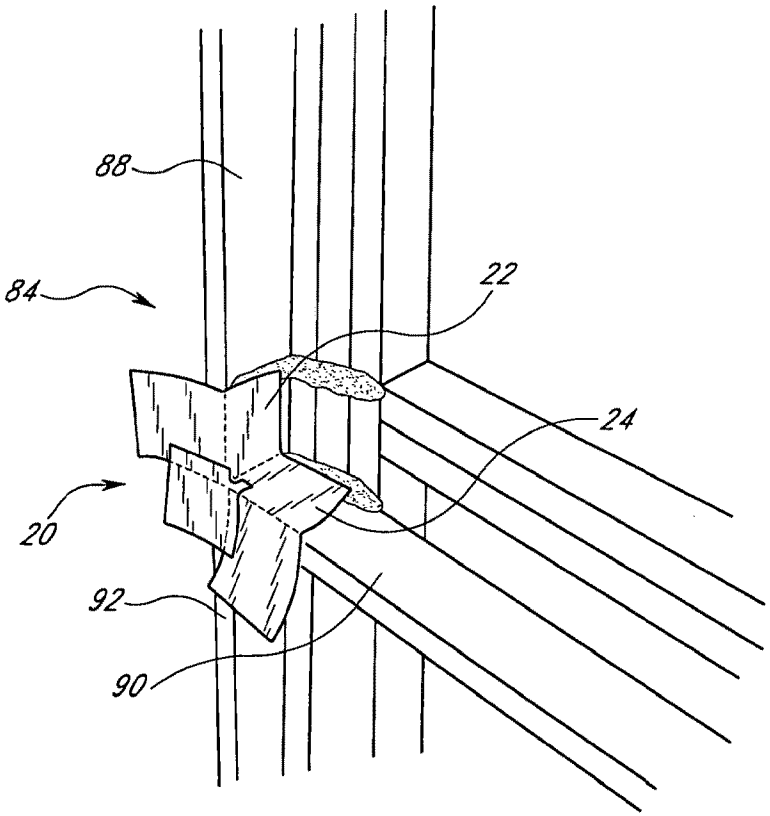
FIG. 7 is a perspective view of a corner of a recessed window frame, illustrating the step of installing a first double-flap member in the corner.
Figure 10:
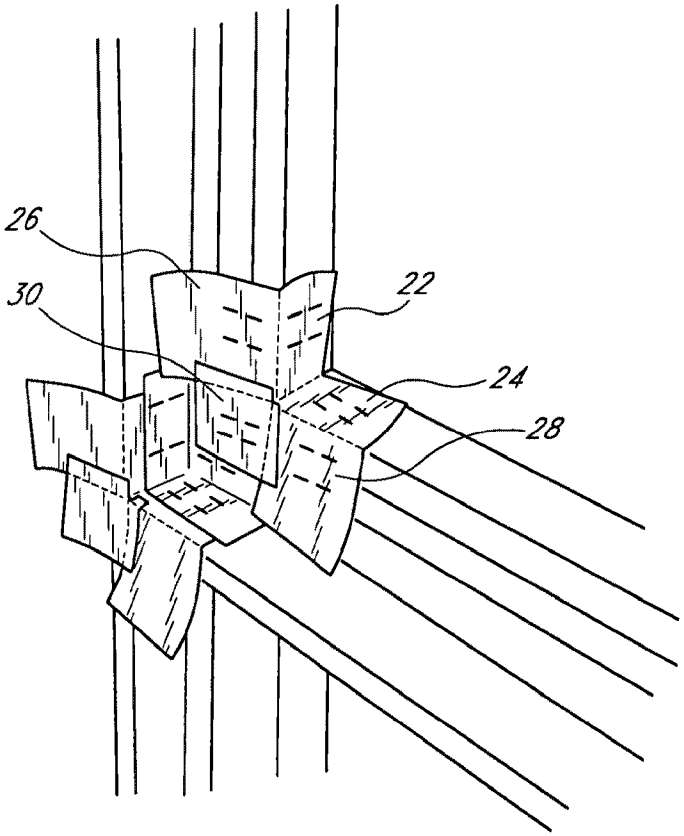
FIG. 10 is a perspective view of a corner of a recessed window frame, illustrating the step of installing a second double-flap member in the corner

As illustrated in FIG. 6, first an L-shaped bead of caulk 80 is applied along a seam between the horizontal sill 90 and the vertical support 88, and along a seam between the horizontal sill 90 and the front surface 94. An identical bead 81 is applied above the first bead 80 at the height of the upper sill 100. Second, a first double-flap member 20 is placed in the corner of the outer frame 84 such that the horizontal 24 and vertical 22 seating flanges contact the horizontal sill 90 and vertical support 88, respectively, of the corner of the outer frame 84. The first double-flap member 20 is placed such that the first flap 26, second flap 28 and web 30 are flush with the front surface 92 of the outer frame 84. The double-flap member 20 is secured in place, preferably with a hammer stapler 96, as illustrated in FIG. 8. Because the flashing material is preferably of an asphalt or petroleum base, it is self-sealing. Thus, the staples do not compromise the water sealing capability of the flashing material.

Figure 9:
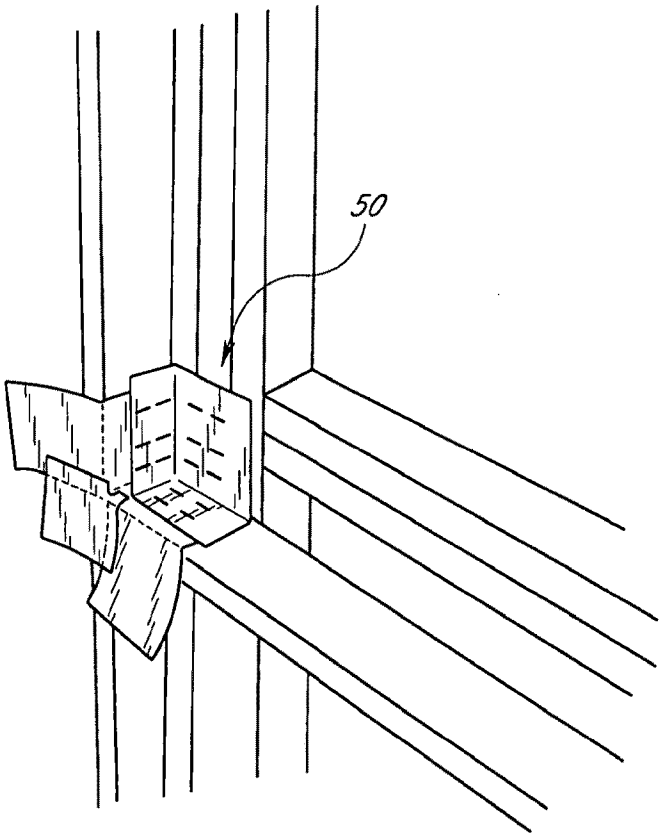
FIG. 9 is a perspective view of a corner of a recessed window frame, illustrating the step of installing a half-cube member in the corner.

In the third step, illustrated in FIG. 9, a half-cube member 50 is placed in the corner of the outer frame 84. The corner of the half-cube 50, where all three edges intersect, sits in the corner of the outer frame 84 so that one face of the half-cube is flush with the front surface 94 of the inner frame 86, one face is flush with the vertical support 88 of the outer frame 84, and one face is flush with the horizontal sill 90 of the outer frame 84. In this orientation, the faces of the cube that are flush with the horizontal sill 90 and vertical support 88 of the outer frame 84, partially overlap the horizontal 24 and vertical 22 seating flanges, respectively, of the double-flap member 20. The half-cube member 50 is secured in place in the same manner as the first double-flap member 20, preferably with a hammer stapler 96.

In the fourth and final step, a second double-flap member 20 is placed in the corner of the inner frame 86, in the same manner and orientation as the first double-flap member 20 was placed in the corner of the outer frame 84. The first flap 26, second flap 28, and web 30 of the second double-flap member 20 partially overlap one face of the half-cube member 50.

To complete the flashing of the recessed window, the remaining corners are finished in the same manner just described, and flashing material is applied to the remaining surfaces of the frame in a manner well known within the art.

Another preferred method of installing the flashing system includes an alternate embodiment of the first and second double-flap members 20. This embodiment, illustrated in FIG. 1C, is substantially identical to the double-flap members 20 already described. This embodiment, however, includes a bead of caulk 32 that is pre-applied to the back of the member 20 along the edge that forms the border between the two seating flanges 22, 24, as shown in FIG. 1C. The pre-applied bead of caulk 32 preferably includes a protective backing to prevent the bead from collecting debris prior to installation.

Because the double-flap members 20 already have a bead of caulk 32 applied to the region that mates with the corners of the window frames 84, 86, there is no need to apply a bead of caulk to the portions of the frames where the pre-applied bead sits. The first step in the installation process, then, is to remove the protective backing from the bead of caulk 32 on the first double-flap member 20 and place the first double flap member 20 into position as described above. The rest of the process proceeds as described above.

Figure 11:
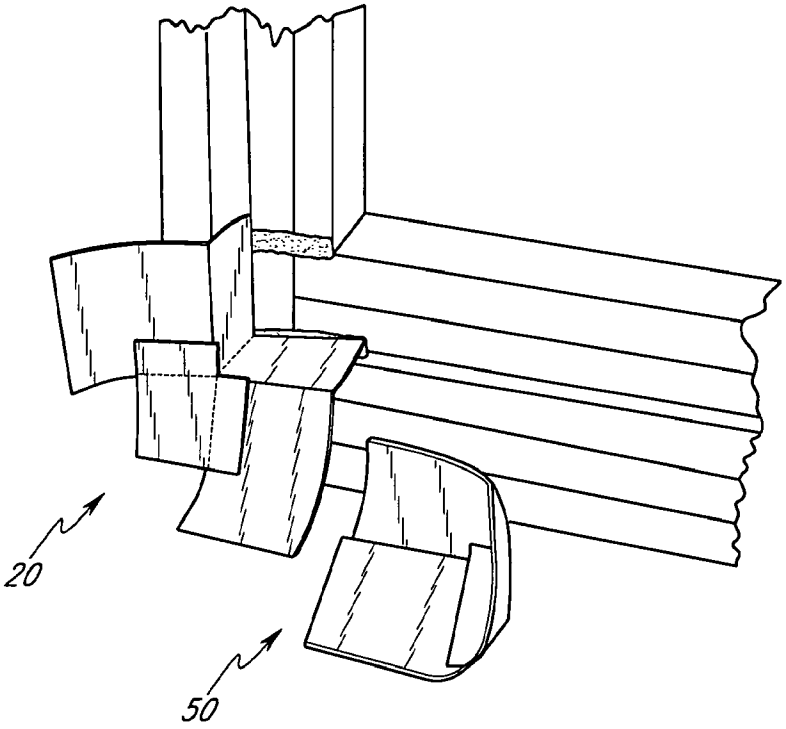
FIG. 11 is a perspective view of a corner of a recessed window frame, illustrating the step of installing a double-flap member in the corner.
Figure 12:
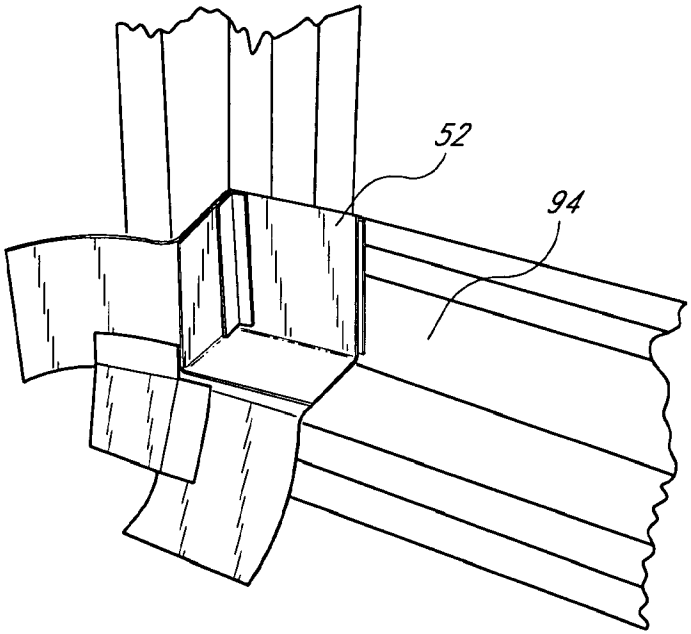
FIG. 12 is a perspective view of a corner of a recessed window frame, illustrating the step of installing a half-cube member in the corner.

In another preferred method of installation, shown in FIGS. 11-14, only one double flap member 20 is installed. The double flap member 20 may or may not include a pre-applied bead of caulk 32. Thus, in the first installation step, caulk is applied to the frame as needed in the locations described above, and if a pre-applied bead of caulk is used, the protective backing is removed. The double flap member 20 is seated in the corner of the outer frame 84 in the same manner as above, and as illustrated in FIG. 11. The half-cube member 50 is also seated in the corner of the outer frame 84 in the same manner as above. In this method, however, the first face 52, which comprises the two flaps 76, 78, is preferably flush with the front surface 94 of the inner frame 86.

Figure 13:
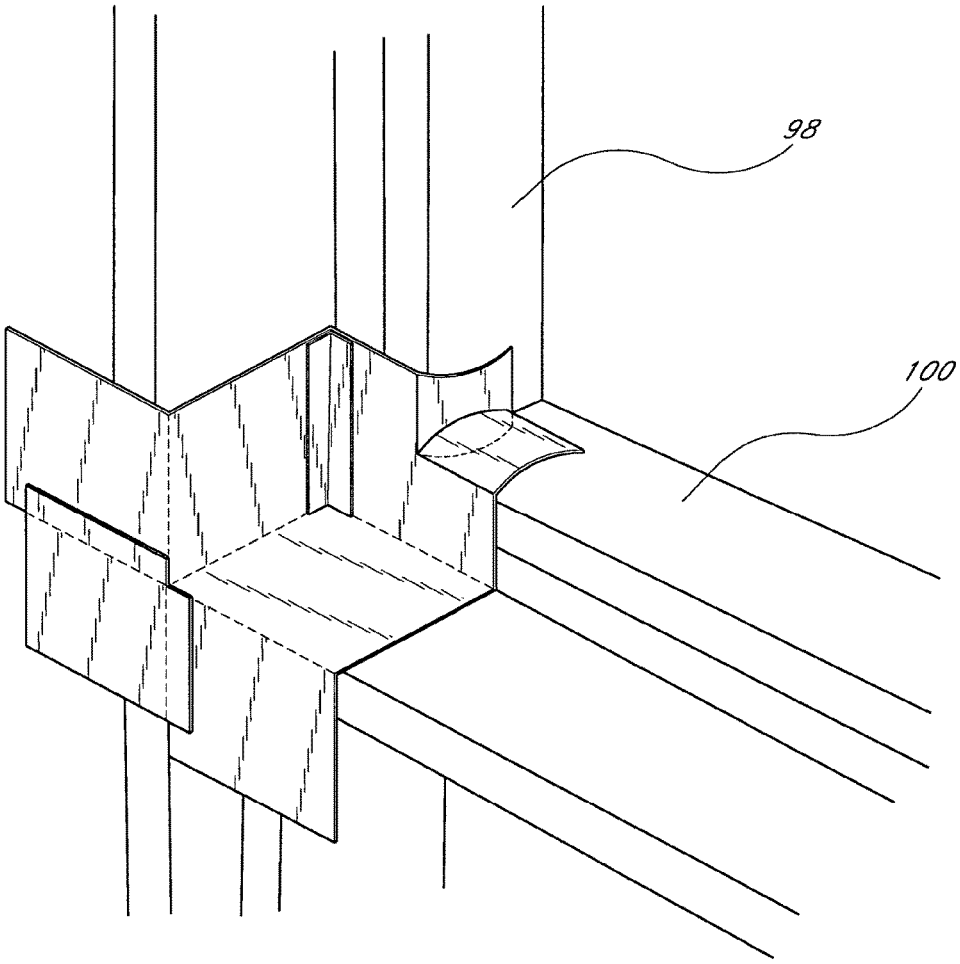
FIG. 13 is a perspective view of a corner of a recessed window frame, illustrating the step of cutting and folding a portion of the half-cube member.
Figure 14:
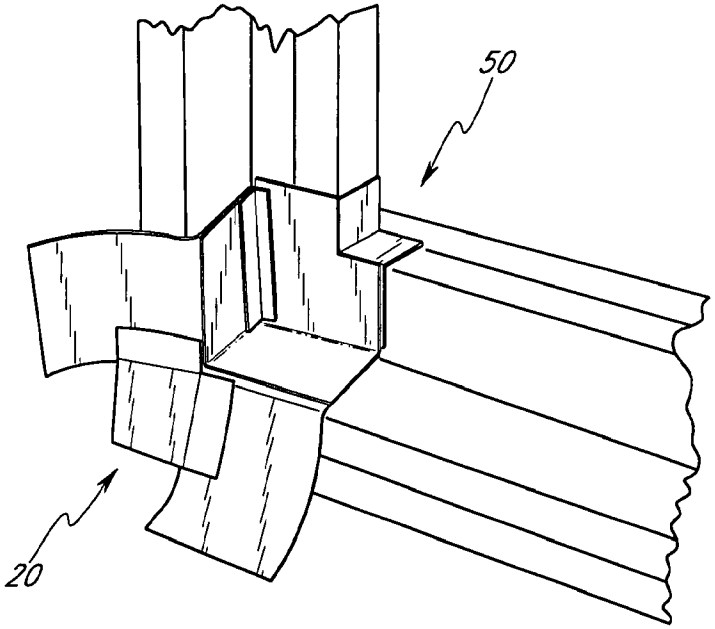
FIG. 14 is a perspective view of a corner of a recessed window frame that has been flashed according to a preferred embodiment of the present flashing system, using one double-flap member and one half-cube member.

Rather than placing a second double-flap member 20 in the corner of the inner frame 86, the corner of the half-cube member 50 is cut and folded over the inner frame as illustrated in FIGS. 13 and 14. Because the first face 52 comprises two flaps 76, 78, one flap is cut and folded across the vertical support 98 of the inner frame, and the other flap is cut and folded across the horizontal sill 100 of the inner frame. Which flap is folded across which face makes no difference. To complete the installation, the folded portions of the flaps are preferably secured to the inner frame 86 with staples.

In another preferred method (not shown) of installing the flashing system, one combination member 102 is installed in a recessed window frame. To begin, caulk is added to the window frame as needed in the same manner as in the previous methods. The combination member 102 is then seated in the corner of the frame such that the flaps 120, 122 are flush with a front surface of the outer frame, and one face 124 of the half-cube component is flush with the front surface of the inner frame. The combination member 102 is preferably secured in place with staples. To complete the installation, either the half-cube component is cut and folded over the inner frame, as described above, or a double flap member is installed in the corner of the inner frame, also as described above.

SCOPE OF THE INVENTION

The above presents a description of the best mode contemplated for the present corner flashing system, and of the manner and process of making and using it, in such full, clear, concise, and exact terms as to enable any person skilled in the art to which it pertains to make and use this corner flashing system. This corner flashing system is, however, susceptible to modifications and alternate constructions from that discussed above which are fully equivalent. Consequently, it is not the intention to limit this corner flashing system to the particular embodiments disclosed. On the contrary, the intention is to cover all modifications and alternate constructions coming within the spirit and scope of the corner flashing system as generally expressed by the following claims, which particularly point out and distinctly claim the subject matter of the corner flashing system.

What is claimed is:

1. A method of flashing a recessed framed wall condition in a building wall, the framed wall condition including an inner frame and an outer frame, the method comprising the steps of:

securing a flexible flashing member generally in a corner of the outer frame of the building wall such that a vertical seating flange of the flashing member contacts a generally vertical surface of the outer frame, a horizontal seating flange of the flashing member contacts a generally horizontal surface of the outer frame, a front seating flange of the flashing member contacts an outer front surface of the outer frame, and a rear seating flange of the flashing member contacts a front surface of the inner frame of the building wall;

wherein at least a portion of the rear seating flange has a height as measured from the horizontal surface of the outer frame to a top edge of the rear seating flange that is less than or equal to a height of the vertical seating flange as measured from the horizontal surface of the outer frame to a top edge of the vertical seating flange.

2. The method of claim 1, wherein the flashing member is folded before being secured to the outer frame such that the front seating flange extends from at least one of the vertical seating flange and the horizontal seating flange at approximately 90 degrees.

3. The method of claim 1, further comprising the step of securing another flashing member generally in a corner of the inner frame of the building wall, such that a vertical seating flange of the another member contacts a generally vertical surface of the inner frame, a horizontal seating flange of the another member contacts a generally horizontal surface of the inner frame, and a front seating flange of the another member overlaps the rear seating flange of the flashing member.

4. The method of claim 1, wherein securing the flashing member generally in a corner of the outer frame of the building wall comprises adhering at least one of the flanges to the outer frame.

5. The method of claim 4, wherein the front seating flange of the flashing member is adhered to an outer front surface of the outer frame.

6. The method of claim 1, wherein securing the flashing member to the building wall comprises securing to the outer front surface of the outer frame at least a portion of the front seating flange that is on a side of the generally vertical surface of the outer frame that is opposite the horizontal seating flange.

7. The method of claim 1, wherein securing the flashing member generally in the corner of the outer frame comprises piercing the flashing member with at least one staple.

8. The method of claim 7, wherein the flashing member substantially seals itself around the at least one staple when the at least one staple pierces the flashing member.

9. A method of flashing a recessed framed wall condition in a building wall, the framed wall condition including an inner frame and an outer frame, the method comprising the steps of:

providing a flexible flashing member having a first flange, a second flange, a third flange, and a fourth flange;

attaching the first flange to a generally vertical surface of the outer frame;

attaching the second flange to a generally horizontal surface of the outer frame;

attaching the third flange to an outer front surface of the outer frame; and attaching the fourth flange to a front surface of the inner frame, wherein a height of a top edge of the fourth flange as measured from the generally horizontal surface of the outer frame is a maximum height at a first portion of the fourth flange and a minimum height at a second portion of the fourth flange, the first portion nearer the first flange than the second portion.

10. The method of claim 9, wherein the first flange is connected to the second flange and wherein the first flange is substantially perpendicular to the second flange when the first and second flanges are attached to the outer frame.

11. The method of claim 10, wherein the second flange is connected to the third flange.

12. The method of claim 11, wherein the second flange is connected to the fourth flange.

* * * * *